US009429405B1

(12) United States Patent
Balzano

(10) Patent No.: US 9,429,405 B1
(45) Date of Patent: Aug. 30, 2016

(54) LESS LETHAL AMMUNITION

(71) Applicant: Alfiero Balzano, Garden Grove, CA (US)

(72) Inventor: Alfiero Balzano, Garden Grove, CA (US)

( * ) Notice: Subject to any disclaimer, the term of this patent is extended or adjusted under 35 U.S.C. 154(b) by 0 days.

(21) Appl. No.: 14/696,983

(22) Filed: Apr. 27, 2015

(51) Int. Cl.
*F42B 12/56* (2006.01)
*F42B 12/40* (2006.01)

(52) U.S. Cl.
CPC ..... *F42B 12/56* (2013.01); *F42B 12/40* (2013.01)

(58) Field of Classification Search
CPC ..... F42B 12/40; F42B 12/46–12/52; F42B 12/56
USPC ..... 102/502, 513
See application file for complete search history.

(56) References Cited

U.S. PATENT DOCUMENTS

| | | | | |
|---|---|---|---|---|
| 3,214,857 | A | 11/1965 | Tyrone et al. | |
| 3,717,097 | A | 2/1973 | Wronka et al. | |
| 5,009,164 | A * | 4/1991 | Grinberg | F42B 8/14 102/501 |
| 5,121,692 | A * | 6/1992 | DiCarlo | F42B 12/46 102/439 |
| 5,393,054 | A * | 2/1995 | Rouffer | F42B 12/40 428/34.1 |
| 6,223,658 | B1 | 5/2001 | Rosa et al. | |
| 6,283,037 | B1 * | 9/2001 | Sclafani | F42B 12/40 102/444 |
| 6,393,992 | B1 * | 5/2002 | Vasel | F41B 15/02 102/367 |
| 6,722,283 | B1 * | 4/2004 | Dindl | F42B 5/145 102/370 |
| 7,526,998 | B2 * | 5/2009 | Vasel | F42B 7/08 102/370 |
| 7,690,311 | B1 * | 4/2010 | Cronemberger | F42B 5/145 102/502 |
| 8,919,255 | B1 * | 12/2014 | Quintana | F42B 12/38 102/449 |
| 2009/0013893 | A1 | 1/2009 | Vasel et al. | |
| 2010/0175577 | A1 * | 7/2010 | Ladyjensky | F42B 12/40 102/513 |
| 2014/0230680 | A1 | 8/2014 | Meller | |

FOREIGN PATENT DOCUMENTS

WO WO2006093527 A2 9/2006

OTHER PUBLICATIONS

The Box O' Truth, #33—Rock Salt in a Shotgun, Jun. 29, 2014.*

* cited by examiner

*Primary Examiner* — Stephen M Johnson
*Assistant Examiner* — Joshua Semick
(74) *Attorney, Agent, or Firm* — Stetina Brunda Garred & Brucker

(57) ABSTRACT

Less lethal ammunition is disclosed for inhibiting activities of a living target, and marking the living target. The ammunition comprises a cylindrical casing, a charged disposed within the cylindrical casing, a cylindrical body defining a bottom cap and a top section. The cylindrical body has first portion disposed within the casing and a second portion extending from the casing. An inhibiting agent is disposed within the casing substantially adjacent the bottom cap, and at least one marking capsule is disposed within the cylindrical body substantially adjacent a top section. A spacer is disposed within the cylindrical body intermediate the inhabiting agent and the marking capsule(s). The ammunition may be fired from a conventional handgun, rifle or shotgun. The cylindrical body is formed of a substantially transparent material to allow a user to visual identify the marking capsules and inhibiting agent within the cylindrical body.

24 Claims, 2 Drawing Sheets

LESS LETHAL AMMUNITION

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention is directed to a less lethal ammunition.

Less lethal projectiles have been used by military and law enforcement forces for crowd control, where it is required to incapacitate an individual or a crowd without the likelihood of causing serious injuries. In such projectiles a metallic projectile/bullet is typically replaced by a projectile made by a soft material, e.g. plastic or rubber. While, such less lethal projectiles are useful to an individual seeking self-defense and/or controlling property related crimes, such less lethal rounds may still cause serious injuries. Moreover, because plastic or rubber bullets are generally similar to conventional lead bullets, there is a risk that a police officer, or other individual in the heat of the moment, may mistakenly insert the wrong kind of ammunition into a conventional firearm, thus leading to a catastrophic loss of life.

Another desirable feature for less lethal ammunition would be to include a marker which identifies the person or object which has been hit by the less lethal ammunition. A marker, such as a paint marker, is useful to identify a person or persons involved in a threat or property crime. Such markings may be useful for identification of individuals involved in the incident. Markers can be of different colors to identify, for example, the person firing the ammunition, or otherwise coordinate to dates, locations, or other circumstances to allow for differentiation in any investigation or arrest.

One common form of a marker is a paint ball projectile, such as commonly used in paint ball competitions. However, paint balls are typically fired through dedicated firearms, and are typically not suitable for use in weapons of conventional calibers, e.g., 9 mm, .38 caliber, .45 caliber, etc. Further as a law enforcement officer typically may not have much time to sort through a variety of devices in order to select an appropriate weapon or device needed to fire less lethal ammunition, it is preferable that the ammunition may be fired from a weapon already located on an officer's belt. Moreover, the range of weapons dedicated to firing paint balls is typically limited, as is their accuracy.

Accordingly, it would be useful to provide less lethal ammunition that provides an inhibiting, or temporarily disabling force, and also provides a marker identifying the person or object that was impacted by the ammunition. Further, it is preferable that such ammunition be compatible with conventional handguns, rifles, and/or shotguns, to allow use in relation to weapons that law enforcement forces already carry.

These and other objects and advantages are addressed by the present invention, which is described in more detail below, in relation to the accompanying exemplary embodiments.

BRIEF SUMMARY

Less lethal ammunition is disclosed for inhibiting activities of a living target, and marking the living target. The ammunition comprises a cylindrical casing, a charged disposed within the cylindrical casing and a cylindrical body defining a bottom cap and a top cap. The cylindrical casing and the cylindrical body are coaxial.

The cylindrical body has first portion disposed within the casing and a second portion extending from the casing. An inhibiting agent is disposed within the casing, substantially adjacent the bottom cap, and at least one marking capsule is disposed within the cylindrical body, substantially adjacent the top cap. A spacer is disposed within the cylindrical body intermediate the inhabiting agent and the marking capsule(s). The ammunition may be fired from a conventional handgun, rifle or shotgun. The cylindrical body is formed of a substantially transparent material to allow a user to visually identify the marking capsules and inhibiting agent within the cylindrical body.

Upon firing the less lethal ammunition, a charge is detonated causing the cylindrical body, the inhibiting agent and the marking capsule to be discharged from the firearm.

Denotation of the charge causes the cylindrical body bottom cap to be perforated by pressurized gas, which also urges the inhibiting agent and the marking capsules to be discharged from the cylindrical body through the cylindrical body top cap.

Upon impact with a living target, or other object, the marking capsule perforates, dispensing marking fluid upon the living target, without obscuring a shooter's vision of the impacted living target.

In one embodiment the marking fluid comprises a staining paint, or other colored fluid.

In another embodiment the marking fluid comprises a malodorant or other chemical compound(s) having an offensive odor.

The cylindrical body is preferably formed of a substantially transparent material such that the marking capsules and the inhibiting agent can be visually identified by a user before loading the ammunition into a firearm.

In some embodiments, the less lethal ammunition is formed to have a length in diameter suitable for firing from a handgun, such as 9 mm, .38 caliber, .45 caliber and .357 caliber handguns.

In other embodiments the less lethal ammunition may be formed to have a length and diameter suitable to be fired from a rifle, such as an M4 rifle.

Yet in other embodiments, the less lethal ammunition may be formed to have a length and diameter suitable to be fired from a conventional shotgun, such as 12 gauge or 20 gauge shotgun.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The above description is given by way of example, and not limitation. Given the above disclosure, one skilled in the art could devise variations that are within the scope and spirit of the invention disclosed herein, including various ways of arranging the cylindrical body within the casing, use of alternative materials/fluids for the inhibiting agent and/or marking fluid, and utilizing different size/numbers of marking capsules within the ammunition. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
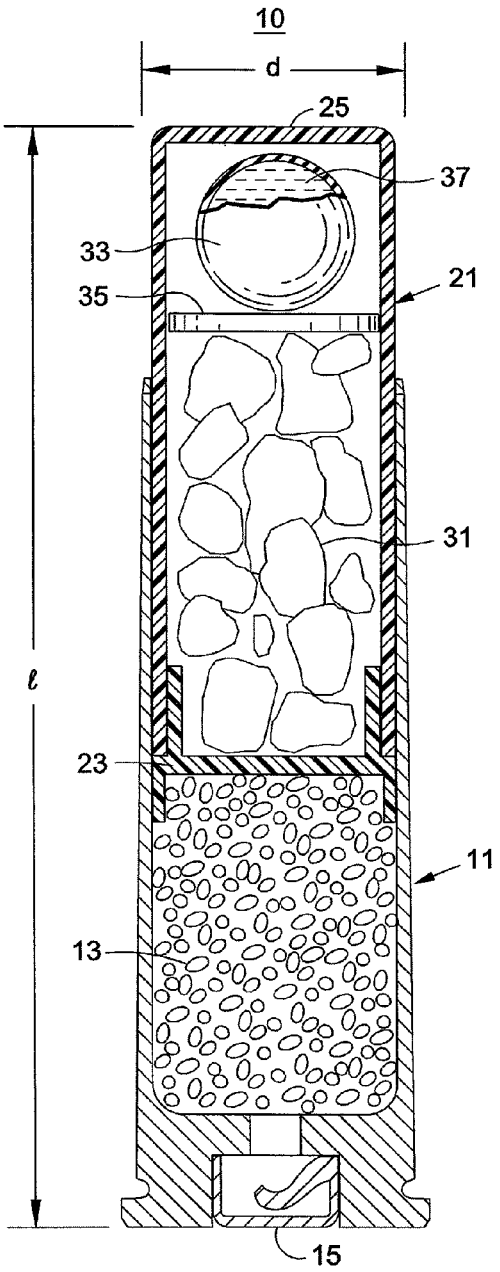
FIG. 1 is a cross-sectional view of an exemplary less lethal ammunition in accordance with the present invention.
Figure 2:
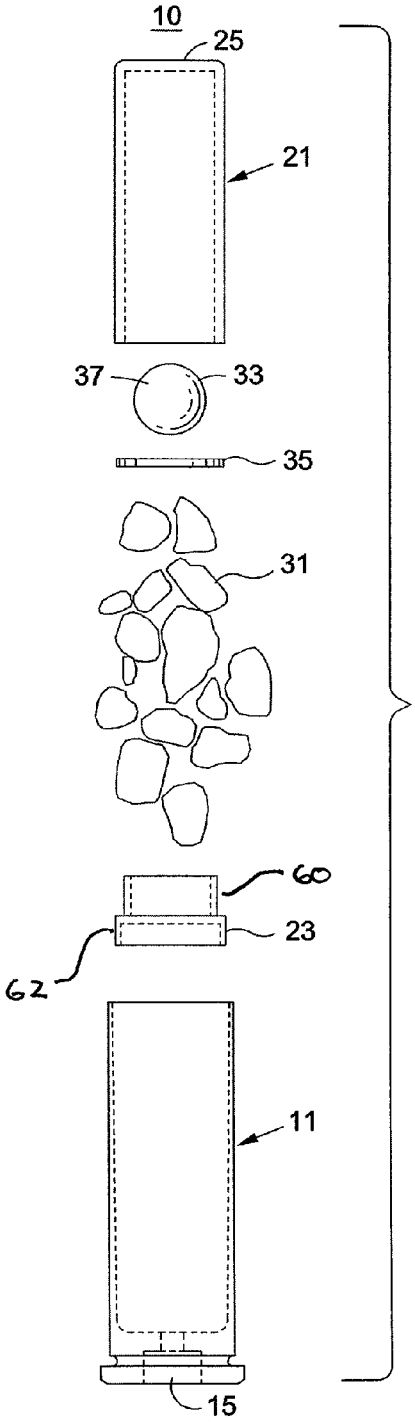
FIG. 2 is an exploded view of the less lethal ammunition shown at FIG. 1.

Referring to the drawings, FIGS. 1 and 2 illustrate the construction and the arrangement of one embodiment of the present invention, wherein the inhibiting agent and marking capsule(s) disposed within a cylindrical body that fits within the diameter of a conventional casing, such as for handgun ammunition or rifle ammunition. For example, the cylindrical body may fit a 9 mm handgun, having a bore diameter of substantially 9 mm, .45 caliber handgun, having bore diameter of substantially 450/1000 of an inch, a .357 handgun, having a bore diameter of substantially 357/1000 of an inch. As for rifle ammunition, the cylindrical body may fit, for example, the ammunition fired by the M4 rifle, which exclusively fires the 5.56×45 mm NATO standard cartridge.

Referring to FIGS. 1 and 2 less lethal ammunition 10 is shown to include a casing 11 within which a charge 13 is disposed. The charge 13 may be detonated by detonator 15, causing the creation of the pressurized gas which discharges the cylindrical body 21 and its contents, from the casing 11. As explained in more detail below, detonation of the charge 13 causes perforation of the cylindrical body which also discharges the inhibiting agent 31 and the marking capsule 33 from the cylindrical body 21.

Cylindrical body 21 includes a bottom cap 23 and a top section 25. The bottom cap 23 includes body section 60 and flange 62. The cylindrical capsule 21 may be loaded to include one or more marking capsules 33, a spacer 35, and inhibiting agent 31. After the contents are loaded into the cylindrical body 21 the cap 23 may be connected to the body 21, to seal the contents therein.

It is to be understood that the marking capsule(s) 33 may include fluid 37, such as paint and/or an alternate colored fluid. In another embodiment the marking capsule 33 may include a malodorant, i.e. a chemical compounding having an offensive odor.

Preferably the size and thickness of the marking capsule 33, the inhibiting agent 31 and the charge 13 are selected such that the marking capsule 33 will not shatter or otherwise perforate prior to impacting a living target. Further, the marking capsule 33 and the marking fluid 37 are selected such that upon impact with a person or object, the marking fluid 37 will be release locally on the impacted target, without being vaporized or otherwise form a cloud that obscures vision of the living target, or his environment, to the person firing the less lethal ammunition. In this way, the law enforcement office or other individual firing the less lethal ammunition will readily know if the ammunition has impacted an intended target, and be able to fire additional rounds at the same or other living targets as may be necessary for defense or to deter additional unlawful or otherwise threatening conduct.

Spacer 35 may be implemented as a thin cylindrical washer, or circular body sufficient to physically space the inhibiting agent 31 from the marking capsules 33, to prevent unintended perforation of the marking capsules 33 by sharp-edged portions of the inhibiting agent 31.

Figure 3:
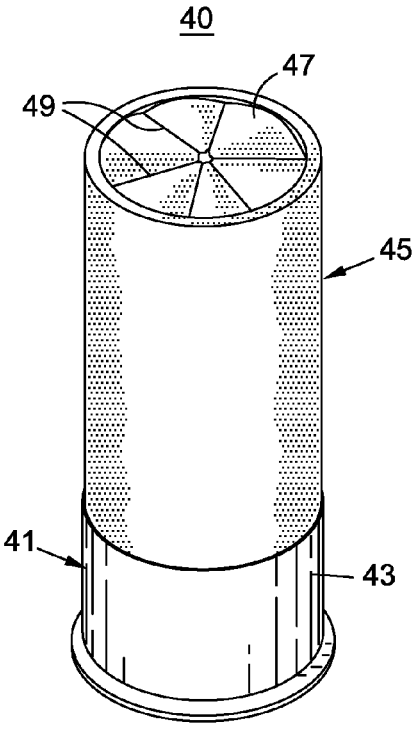
FIG. 3 is a perspective view of an alternate implementation of the less lethal ammunition for a shotgun.
Figure 4:
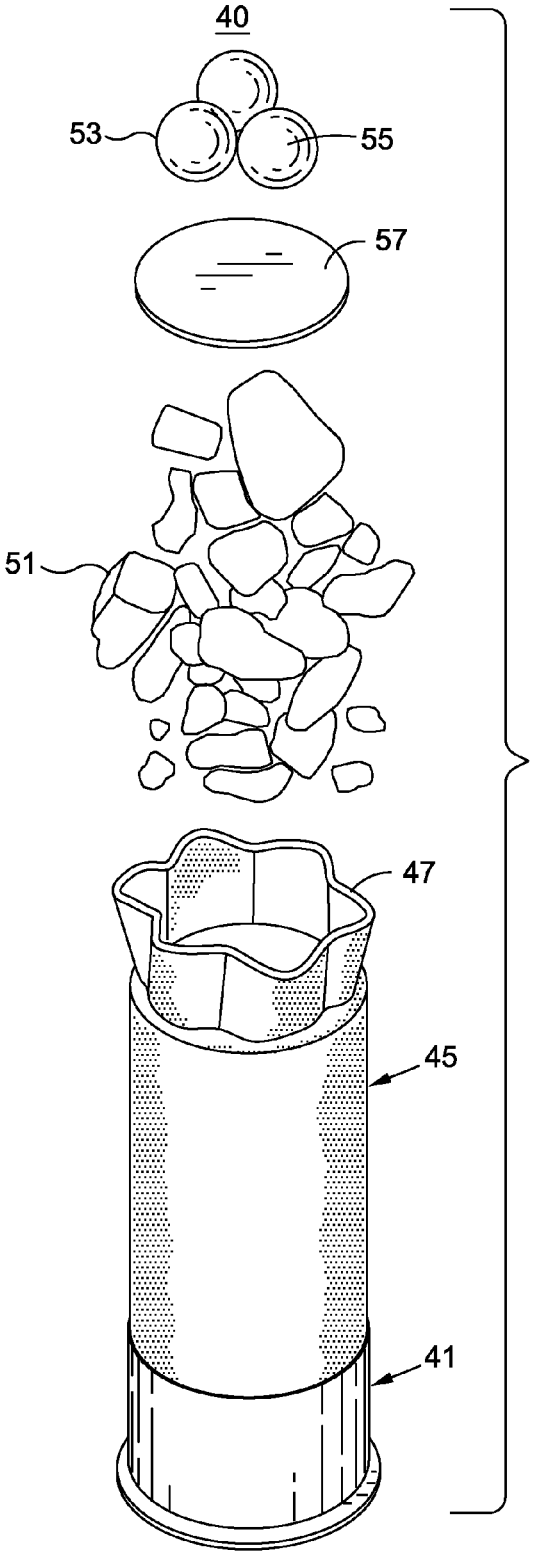
FIG. 4 is an exploded view of the less lethal ammunition shown at FIG. 3.

FIGS. 3 and 4 illustrate another embodiment of the present invention, as adapted for use in connection with shotgun ammunition. As shown therein, less lethal ammunition 40 is shown to be externally similar to a traditional shotgun shell, with the contents modified to include marking capsules and an inhibiting agent. In this embodiment a separate cylindrical body is not used to contain the marking capsules and the inhibiting agent. Rather they are disposed within the ammunition 40.

Less lethal ammunition 40 is shown to include a casing 41, which may include a charge 43 disposed therein (similar to charge 13 described and illustrated in connection with FIGS. 1 and 2). Cylindrical housing 45 is attached to the casing 41 and contains the inhibiting agent 51, the marking capsule 53, and spacer 57.

As with conventional shotgun shells, the top 47 of ammunition 40 defines scores 49 which, in response to detonation of a charge 43, are urged upwardly and outwardly to discharge the contents of housing 45, i.e. the marking capsules 53, the inhibiting agent 51 and spacer 57.

The ammunition 40 may have a length and diameter compatible with 12 gauge or 20 gauge shotgun shells. Indeed, ammunition 40 may be fabricated by using traditional shotgun shells, from which the contents are removed and the inhibiting agent 51, marking capsules 53 and spacer 57 are substituted therefor. As is well known in the art, a 12 gauge shotgun has a bore diameter of substantially 12 gauge, and a 20 gauge shotgun has a bore diameter of substantially 20 gauge.

As discussed previously in connection with FIGS. 1 and 2, the marking capsules 53 may include fluid content 55 therein. The fluid 55 may mark a target with a colored paint, other colored materials and/or a malodorant. In alternate implementations, other fluids may be utilized within the capsule 53 as may be effective for specific applications.

As one of ordinary skill will recognize, the present invention has been described in relation to the illustrated exemplary embodiments, but may be implemented in additional embodiments where the components of the ammunition may implement the same functional features in another and/or equivalent manner. As such, the present invention is not intended to be limited by the foregoing illustrations and accompanying description.

What is claimed is:

1. Less lethal ammunition for inhibiting activity of a living target and marking the living target impacted by the ammunition, the ammunition comprising:

a cylindrical casing;

a detonator disposed on a closed end of the cylindrical casing;

a charge disposed within the casing adjacent the detonator;

a cylindrical body defining a diameter, and a bottom cap and a top section, the cylindrical body having a first portion disposed within the casing and a second portion extending from the casing, and a longitudinally arranged payload, comprising;

an inhibiting agent disposed adjacent a first end of the cylindrical body;

at least one marking capsule disposed adjacent a second end of the cylindrical body, the marking capsule having a marking fluid therein; and a spacer disposed within the cylindrical body intermediate the inhibiting agent and the at least one marking capsule;

wherein the detonator and the charge disposed within the casing are the only charges in the ammunition.

2. The less lethal ammunition as recited in claim 1 wherein the cylindrical casing and the cylindrical body are coaxial.

3. The less lethal ammunition as recited in claim 1 wherein upon firing of the ammunition in a firearm, the charge is detonated causing the cylindrical body, the inhibiting agent and the marking capsule(s) to be discharged from the firearm.

4. The less lethal ammunition as recited in claim 3 wherein upon firing of the ammunition in a firearm, the cylindrical body bottom cap and top section are perforated, and inhibiting agent and the marking capsule(s) are discharged from the cylindrical body.

5. The less lethal ammunition as recited in claim 4 wherein upon impact with the living target the marking capsule perforates, dispersing the marking fluid on the living target.

6. The less lethal ammunition as recited in claim 4 wherein upon impact upon the living target, the marking capsule disperses the marking fluid locally upon the impacted person or object, without obscuring vision of the impacted living target.

7. The less lethal ammunition as recited in claim 1 wherein the marking fluid is a colored fluid.

8. The less lethal ammunition as recited in claim 1 wherein the marking fluid
comprises a chemical compound having an offensive odor.

9. The less lethal ammunition as recited in claim 1 wherein the cylindrical body is formed of substantially transparent material, such that the marking capsule(s) and the inhibiting agent therein can be visually identified.

10. The less lethal ammunition as recited in claim 1 wherein the casing diameter defines an ammunition diameter and wherein the casing and the cylindrical body second portion define an ammunition length.

11. The less lethal ammunition as recited in claim 1, wherein the bottom cap defines a body section and a flange, the body section having an outside diameter less than an inside diameter of the top section, and the flange having an outside diameter equal to the outside diameter of the top section, the body section located inside the top section.

12. The less lethal ammunition as recited in claim 10 wherein the cylindrical body diameter is suitable for firing the ammunition from a 9 mm handgun.

13. The less lethal ammunition as recited in claim 10 wherein the cylindrical body diameter is suitable for firing the ammunition from a .45 caliber handgun.

14. The less lethal ammunition as recited in claim 10 wherein the cylindrical body diameter is suitable for firing the ammunition from a .357 caliber handgun.

15. The less lethal ammunition as recited in claim 1, wherein the inhibiting agent comprises jagged edges sharp enough to pierce the marking capsule when the cylindrical body is accelerated by the firing of the ammunition.

16. The less lethal ammunition as recited in claim 10 wherein ammunition diameter and ammunition length are suitable for firing the ammunition from an M4 rifle.

17. Less lethal ammunition for inhibiting activity of a living target and marking the living target impacted by the ammunition, the ammunition comprising:

a marking capsule containing a dye;

an inhibiting agent to impact on a target, the inhibiting agent comprising a plurality of particles of solid matter, each particle of solid matter comprising sharp edges;

a housing defining a first exterior diameter, the housing surrounding the marking capsule and the inhibiting agent, and arranging the marking capsule and the inhibiting agent in two longitudinally arranged sections, and comprising scores which move from a first position in which the scores enclose a first end of the housing, to a second position, in which the scores are urged distally and radially outward; and a casing defining a second exterior diameter, the casing enclosing a second end of the housing;

wherein the first exterior diameter and the second exterior diameter are equal, the entire structure of the marking capsule remains intact until impact on a target, and the dye contained by the marking capsules, when released from the marking capsules by the marking capsules impact with the target, is released locally on the target and is not vaporized or otherwise forms a cloud that obscures any line of sight to the target.

18. The less lethal ammunition as recited in claim 17 wherein the first exterior diameter and the second exterior diameter are suitable for firing the ammunition from a 12 gauge shotgun.

19. The less lethal ammunition as recited in claim 17 wherein the first exterior diameter and the second exterior diameter are suitable for firing the ammunition from a 20 gauge shotgun.

20. The less lethal ammunition as recited in claim 17, further comprising a spacer located in the housing in between the marking capsule and the inhibiting agent.

21. Less lethal ammunition for inhibiting activity of a living target and marking the living target impacted by the ammunition, the ammunition comprising:

a cylindrical casing;

a detonator disposed on a closed end of the cylindrical casing;

a charge disposed within the casing adjacent to the detonator;

a cylindrical body defining a bottom cap comprising a body section and a flange, the flange defining a first outside diameter, and a top section defining a second outside diameter, the cylindrical body having a longitudinally arranged payload, comprising;

an inhibiting agent disposed adjacent a first end of the cylindrical body, the inhibiting agent comprising sharp edges; and at least one marking capsule disposed adjacent a second end of the cylindrical body, the marking capsule having a marking fluid therein;

wherein the first outside diameter and the second outside diameter are equal, the entire structure of the marking capsule remains intact until impact on a target, and the dye contained by the marking capsules, when released from the marking capsules by the marking capsules impact with a target, is released locally on the target and is not vaporized or otherwise forms a cloud that obscures any line of sight to the target; and wherein the detonator and the charge disposed within the casing are the only charge in the ammunition.

22. The less lethal ammunition as recited in claim 21, wherein the marking fluid marks the target directly from the capsule.

23. The less lethal ammunition as recited in claim 21, wherein, after being fired from a firearm, the inhibiting agent exits the cylindrical body prior to impacting a target.

24. The less lethal ammunition as recited in claim 21, wherein the first end is the proximal end.

* * * * *